US006264530B1

(12) United States Patent
Cosentino

(10) Patent No.: US 6,264,530 B1
(45) Date of Patent: Jul. 24, 2001

(54) ABSORBABLE-DISPOSABLE BRA SHIELD

(76) Inventor: Judith A. Cosentino, 518 Moonstone Way, Orlando, FL (US) 32806

( * ) Notice: Subject to any disclaimer, the term of this patent is extended or adjusted under 35 U.S.C. 154(b) by 0 days.

(21) Appl. No.: 09/685,211

(22) Filed: Oct. 11, 2000

(51) Int. Cl.[7] ..... A41C 3/12
(52) U.S. Cl. ..... 450/57; 450/60; 2/267
(58) Field of Search ..... 450/60, 53, 86, 450/57, 81, 80, 56, 61, 62; 2/73, 267, 463, 455, 53, 56, 57, 1

(56) References Cited

U.S. PATENT DOCUMENTS

| | | | |
|---|---|---|---|
| 5,269,720 | 12/1993 | Moretz et al. | 450/37 |
| 5,385,502 | 1/1995 | Moretz et al. | 450/93 |
| 5,603,653 | 2/1997 | Hartman | 450/56 |
| 5,664,984 | 9/1997 | Laughridge | 450/57 |
| 5,716,255 | 2/1998 | Abercrombie et al. | 450/60 |
| 5,964,641 | 10/1999 | Laughridge | 450/57 |
| 5,980,359 * | 11/1999 | Brown | 450/60 |

* cited by examiner

*Primary Examiner*—Gloria M. Hale
(74) *Attorney, Agent, or Firm*—Patent & Trademark Services; Thomas Zack; Joseph H. McGlynn

(57) ABSTRACT

A brassiere having a breast supporting portion with a moisture managing shield. The moisture managing shield faces towards the skin of a wearer is attached to one side surface on the lower portion of the brassiere by a first adhesive layer. A depending lower portion of the shield is attached to the second or outside surface of the lower portion of the brassiere by a second adhesive layer by folding the shield along a lower edge. Each of the adhesive layers are initially covered by peel off strips until it is desired to expose their adhesive backings for mounting to the brassiere. Normally, the lower inside portion of the brassiere below the breast retaining cups is completely covered by the shield. The in-place shield may be removed from the brassiere by pulling on the shield allowing for its disposal and replacement by another shield when needed.

4 Claims, 1 Drawing Sheet

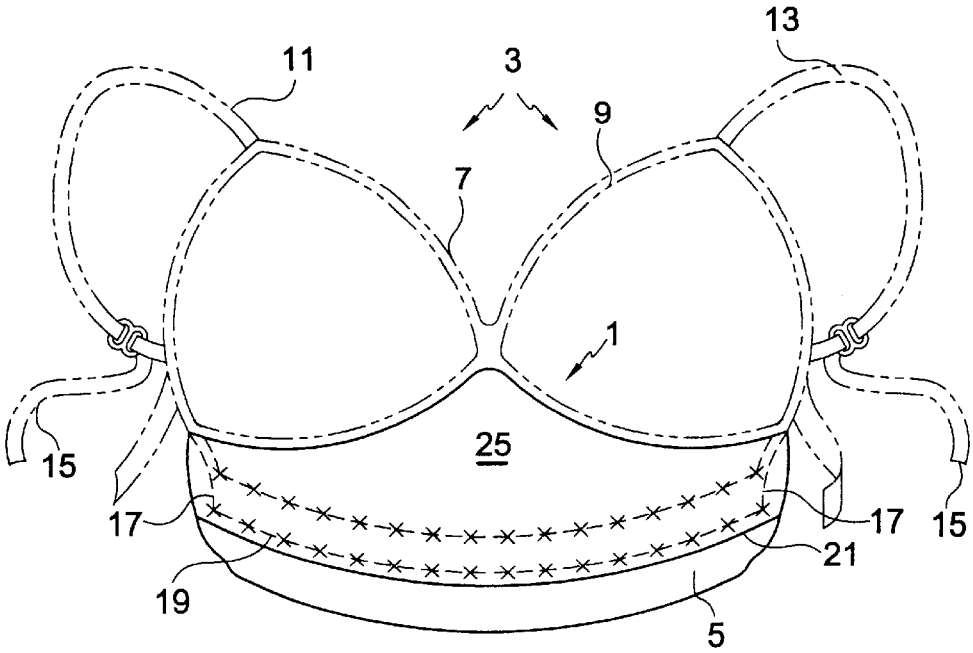
FIG.1
FIG.2
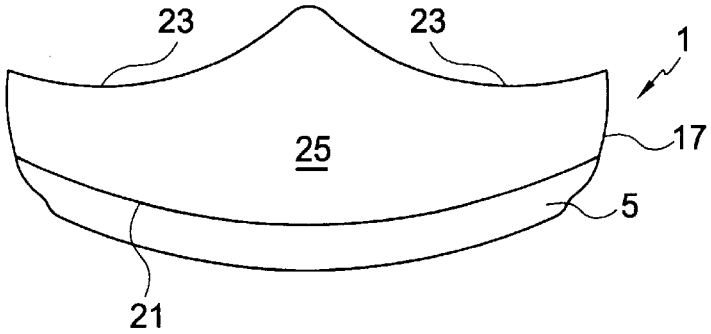
FIG.3
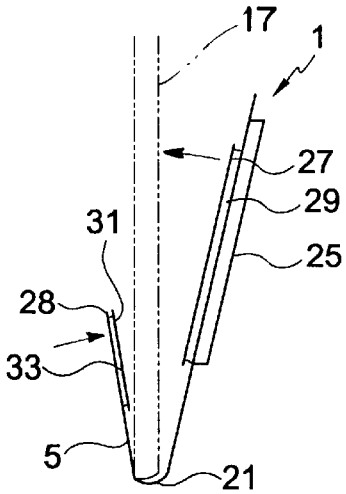

ABSORBABLE-DISPOSABLE BRA SHIELD

BACKGROUND OF THE INVENTION

This invention relates to a brassiere (bra) shield usable with a bra that both absorbs moisture and is disposable. Moisture managing brassieres or bras are known. In one earlier invention a moisture management bra is made from a stretch fabric material having a moisture transport fabric layer constructed of hydrophilic yarn.

Another moisture managing bra was made from a material which wicks moisture away from the skin of the wearer. Perspiration absorbent pads secured to bra cups can be used to absorb perspiration from the skin of a wearer in other inventions.

One invention discloses a pad made of moisture absorbent material that is secured by adhesive to the bra such that a shield fits under the breasts and extends between the breasts.

Still another moisture absorbing bra has a perspiration absorbent pad which can be secured into the cups of the bra to absorb perspiration from the skin of a wearer.

DESCRIPTION OF THE PRIOR ART

Brassieres or bras that provide for the managing and absorbing of moisture are known in the art. For example, U.S. Pat. No. 5,269,720 to Moretz et al. discloses a moisture management bra is made from a stretch fabric material having a moisture transport fabric layer constructed of hydrophilic yarn.

U.S. Pat. No. 5,385,502 to Moretz et al. discloses a moisture managing bra was made from a material which wicks moisture away from the skin of the wearer.

U.S. Pat. No. 5,603,653 to Hartman and U.S. Pat. No. 5,664,984 to Laughridge disclose perspiration absorbent pads which can be secured into the cups of a bra (Hartman) or between the cups of a bra (Laughridge) to absorb perspiration from the skin of a wearer.

U.S. Pat. No. 5,716,255 to Abercrombie et al. discloses a pad made of moisture absorbent material that is secured by adhesive to the bra such that a shield fits under the breasts and extends between the breasts.

U.S. Pat. No. 5,964,641 to Laughridge discloses a perspiration absorbent pad which can be secured into the cups of the bra to absorb perspiration from the skin of a wearer.

In the present invention a bra shield is secured to a bra and fits under the breasts and extends between the breasts and has a peel off adhesive layer to attach the shield to the outside of the bra and a lower portion which bends over the bra bottom with a peel off adhesive layer to attach a pad to the inside of the bra all as will be detailed in the specification that follows hereafter.

SUMMARY OF THE INVENTION

This invention relates to a brassiere or bra having an moisture absorbing layer on the inside of the bra that bears against the skin of a wear with a first adhesive layer under a peel off backing and a second adhesive layer under a peel off layer which second layer bends around the lower portion of the bra to engage the lower outside edge of the bra to secure the moisture absorbing layer.

It is the primary object of the present invention to provide for an improved moisture absorbing layer or shield for a brassiere.

Another object is to provide for such an absorbing layer in which peel off layers cover the distal ends of the layer each with an adhesive layer below them and which when fitted on a bra extend to the front or outside edge of the bra and to the inside of the bra.

These and other objects and advantages of the present invention will become apparent to readers from a consideration of the ensuing description and the accompanying drawings.

BRIEF DESCRIPTION OF THE DRAWINGS

FIG. 1 is a view of the present invention showing the moisture absorbing shield mounted to the inside of a bra with the lower edge of the shield having a peel off layer over an adhesive lower strip.

FIG. 2 is a view of the shield shown in FIG. 1 by itself with no bra.

FIG. 3 is side view of a shield as in FIG. 2 and a portion of the bra with two peel off layers over adhesive layers.

DESCRIPTION OF THE PREFERRED EMBODIMENT

FIG. 1 is a view of the present invention showing the moisture absorbing shield 1 mounted to the inside of a bra 3, shown in dotted line format, with the lower depending portion 5 of the shield. The opposite side surface of portion 5 has a peel off layer strip covering over an adhesive lower strip, either of which are shown in this figure. The brassiere or bra 3 is conventional in design and has two joined breast cups 7 and 9 each of which upper edges have supporting shoulder straps 11 and 13, partially shown. These straps may extend from the cups to a back strap 15 (also partially shown). The back strap extends from each side of a the cup around the body of a user and may have end fasteners (not shown). In this view the cups are positioned such that a viewer is looking from the inside of the bra or the side that engages the user's breasts. Below the cups and behind the shield 1 is an extending lower bra portion 17, shown in dotted line format, that engages the front of a user's body below the breasts. The lower edge 19 of bra portion 17 is shown to be almost at the same level as the upper edge of the lower shield portion 5 with a peel off layer and covered adhesive lower strip (best shown in FIG. 3). To retain the covering shield 1 to the bra's lower portion 17 this first adhesive layer strip has previously had its covering peel off layer removed with the adhesive material beneath it directly engages the underlying portion 17. The Xs represent the approximate location of the first adhesive layer that directly engages the bra portion 17 to act to retain the shield to the inside of the bra. This first adhesive layer or inside adhesive layer is also shown in FIG. 3. Outside of the adhesive layer represented by Xs and between that layer and a user's body is the moisture absorbing material (25) making up most the surface area of the shown shield 1. The the lower shield strip portion 5 has a facing covering peel off layer (not shown in this figure) on its side opposite to that shown in this figure. This lower shield portion is to be folded inwardly along line 21 such that when so folded and its peel off layer is removed, the second exposed adhesive layer may be bonded to the lower outside surface of the adjacent facing bra portion 17.

FIG. 2 is a view of the shield shown in FIG. 1 by itself with no bra. The top portion 23 of the shield 1 is configured to resemble the lower cup edges for the two cups 7 and 9. The main area of the shield's body portion 25 is facing inside that engages the skin of a wearer and is made of a moisture absorbing material, such as the material used for baby's diapers or women's sanitary panty liners. This absorbing material directly engages the skin of a user on the lower portion of the breasts and below.

FIG. 3 is side view of a shield as in FIG. 2 with two peel off layers shown over adhesive layers. The moisture absorbing layer 25 extends to the right towards the skin of a user. Only the lower portion 17 of the bra is shown in this figure. Between this lower bra portion 17 and the layer 25 is the first peel off strip layer 27 that covers adhesive layer 29 which is positioned between the layer 27 and the surface of absorbent layer 25. A second peel off layer strip 31 is positioned between the outside surface of the bra's lower portion 17 and a second adhesive layer 33. Both peel off layer strips need to be completely removed to firmly attach the layer 25 to the bra. In this view the lower shield flap portion 5 has been folded inwardly with its shield edge 28 facing upwardly. This is done by folding the shield portion along horizontally disposed line 21 such that, when covering second strip 31 is removed, the second adhesive layer 33 will directly engage the outside bra surface. Thus, when the two peel off strips 27 and 31 are removed, their underlying adhesive layers are exposed and these layers face each other and are pressed together to engage opposite bra sides i.e., the inside and outside surfaces. Using two adhesive surfaces, one on the inside of the bra and one on the outside edge, provides for a firm shield attachment that is also removable from the bra. Normally, the formed lower outside portion of the shield that is folded along the lower edge 21 when adhesively attached to the front or outside of the brassiere extends up the surface of the brassiere considerably less than the shield surface on the opposite side of the brassiere.

It is important to note that although there are two facing adhesive layers, the shield 1 can still be removed from the bra 3 by pulling on the shield allowing for the disposal of the shield and its replacement by a new shield. The adhesives used are slow setting adhesives that do not permanently bond the shield to the brassiere. Thus, the shield 1 can be completely detached from the bra and disposed of when sufficient moisture has been absorbed by the material 25. The arrows shown indicate the directions the exposed adhesive surfaces are moved towards the bra to attach the shield to it.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A brassiere having a breast supporting portion with a moisture managing shield comprising in combination:

a brassiere having a breast supporting portion including two breast cups and a lower portion;

said lower portion includes an inner surface and an outer surface, and wherein said inner surface is adjacent the skin of the wearer, a moisture managing shield attachable to one of said inner and outer surfaces by a first adhesive layer, said shield having a moisture absorbing layer facing towards the skin of a wearer; and said shield being attachable to the lower portion of the brassiere by a second adhesive layer by folding the shield above a lower edge.

2. The combination as claimed in claim 1, also including covering peel off strips for said first adhesive layer and said second adhesive layer.

3. The combination as claimed in claim 2, wherein the lower portion of the brassiere is completely covered on the side facing a wearer by the shield.

4. The combination as claimed in claim 3, wherein the formed lower portion of the shield, that is folded above a lower edge when adhesively attached, extends up the surface of the brassiere less than the shield surface on the opposite side of the brassiere.

* * * * *